US006821083B2

(12) United States Patent
Lathrop et al.

(10) Patent No.: US 6,821,083 B2
(45) Date of Patent: Nov. 23, 2004

(54) SUPPORT STRUCTURE FOR STREAM TURBINE BEARING HOUSING

(75) Inventors: Norman D Lathrop, Ballston Lake, NY (US); Douglas C. Hofer, Clifton Park, NY (US); Edward J Sharrow, Scotia, NY (US); John Keeling, Niskayuna, NY (US); Robert J. Sherwood, Fonda, NY (US); Christen A. Vitrone, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/360,230

(22) Filed: Feb. 6, 2003

(65) Prior Publication Data

US 2004/0156720 A1 Aug. 12, 2004

(51) Int. Cl.[7] ..... F01D 25/16; F01D 25/24

(52) U.S. Cl. ..... 415/142; 415/108; 415/213.1; 415/214.1; 415/229

(58) Field of Search ..... 415/108, 111, 415/112, 142, 168.1, 175, 176, 213.1, 214.1, 229; 248/637, 672, 674–679

(56) References Cited

U.S. PATENT DOCUMENTS 1,678,968 A * 7/1928 Allen ..... 415/213.1
2,616,662 A * 11/1952 Mierley ..... 415/213.1
4,076,452 A * 2/1978 Hartmann ..... 415/142
5,094,588 A * 3/1992 Gros ..... 415/213.1
5,106,264 A * 4/1992 Gros ..... 415/213.1
5,108,258 A * 4/1992 Gros ..... 415/213.1
5,272,869 A * 12/1993 Dawson et al. ..... 415/142
5,509,782 A * 4/1996 Streeter ..... 415/213.1
5,813,828 A * 9/1998 Norris ..... 415/142
6,030,176 A * 2/2000 Oeynhausen ..... 415/214.1

* cited by examiner

*Primary Examiner*—Christopher Verdier
(74) *Attorney, Agent, or Firm*—Polster, Lieder, Woodruff & Lucchesi, L.C

(57) ABSTRACT

A casing (12) for a steam turbine section has a housing (14) installed therein for a bearing supporting a rotor for buckets. A housing support structure (10) includes a pair of horizontally extending struts (T1–T2) extending from a side (18) of the casing to the housing and a second pair of struts (T3, not shown) extending from the opposite side of the casing to the housing. The struts are in fluid communication with the interior of the housing and the atmosphere and both support the housing within the casing and vent the interior of the housing. Vertical struts (T4–T6) also extend between the casing and the housing. A foundation plate (20) is installed beneath the casing, and a pair of gibs (28) are installed on opposite sides of the casing along the longitudinal centerline thereof to strengthen the casing and prevent tilting of components within the casing when a vacuum within the casing is present.

16 Claims, 3 Drawing Sheets

SUPPORT STRUCTURE FOR STREAM TURBINE BEARING HOUSING

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to an improved support structure for a bearing installed in a low pressure (LP) section of a steam turbine.

Referring to the drawings, a section of a turbine T is shown in FIG. 1. The section shown in FIG. 1 is a portion of a low pressure section of the turbine and includes an axial flow LP bearing support or housing B of a conventional design. A bearing (not shown) installed in the housing supports the hub of a rotor (also not shown) to which are mounted turbine blades or buckets (also not shown). A metal shell or casing H comprises a hollow cylinder. Axially mounted within the shell is a cylindrically shaped housing B closed at one end and to which pipes P are attached for venting and sealing the bearing assembly, all as is well known in the art. The housing is supported within the shell by struts S.

Four struts S1–S4 are horizontal plates two of which extend inwardly from opposite sides of inside wall W1 of the shell. Another strut S5 extends vertically from the underside of the housing to the bottom of the inside wall surface. Finally, there are two struts S6 and S7 which extend from the underside of housing B at approximately 45° angles to the side of the shell. These struts are located on opposite sides of strut S5. The struts S5–S7 also are comprised of plates and the three struts are co-planar with each other as installed.

Foundation plates F (only one of which is shown in FIG. 1) are attached to an outer wall W2 of the shell at a location approximately 36 inches (91 cm) below the centerline of shell H. The foundation plates are located opposite of each other. Axial gibs G (again only one of which is shown in FIG. 1) are also installed on the outside of the shell. The gibs, which are also located approximately 36 inches (91 cm) below the centerline of shell H, serve to constrain the structure axially. An access hatch C is located in the top of shell H. An atmospheric relief diaphragm (not shown) is installed in the opening to prevent overpressure conditions from damaging the turbine.

A major problem with this construction is that the support provided by the various struts, plates, and gibs does not consistently provide for reliable startup and operation of the turbine of which the LP section forms a part. That is, the vibration created during turbine start-up will sometimes cause excessive movements in the structure that cause internal damage to the turbine. For example, the support struts have been found not to provide adequate structural integrity. Also, because of the location of the gibs, when a vacuum is drawn within the exhaust casing an undesirable tilting of the LP assembly occurs.

These faults have been demonstrated by extensive field work as well as by finite element analyses (FEA). Besides the various startup problems which occur, there are also losses in performance due to parts rubbing together, steam leakages through the packing rings housed within this section, exhaust pressure loss, and packing rubs.

By redesigning the existing bearing support structure, these problems can be overcome. In addition, exhaust steam pressure recovery in the LP section of the turbine can be improved which results in enhanced performance in this section of the turbine.

BRIEF SUMMARY OF THE INVENTION

Briefly stated, the present invention is directed to a bearing support structure for the LP section of a steam turbine which provides greater stiffness than obtained from current bearing support structures. The bearing support structure significantly differs from previous designs in the number, size, location, and the shape of struts comprising the support structure. By optimizing internal strut shape, quantity, and placement, better and more consistent performance of the turbine, both during startup, and subsequently, is achieved. Further, foundation plates and gibs have been relocated to improve bearing support stiffness and eliminate tilting problems during operation. The resulting structure also minimizes packing ring rubs which otherwise occur because of insufficient support stiffness.

The bearing support structure of the invention has been shown, through the use of finite element analysis, to have substantially improved bearing support stiffness. It has further been shown, through computational fluid dynamics (CFD) analysis, to significantly improve the performance of a steam turbine over turbines having a conventional LP bearing support arrangement. Consequently, steam turbine performance is now improved using the new support design described herein, rather than the support geometry shown in FIG. 1.

Other objects and features will be in part apparent and in part pointed out hereinafter.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 2:
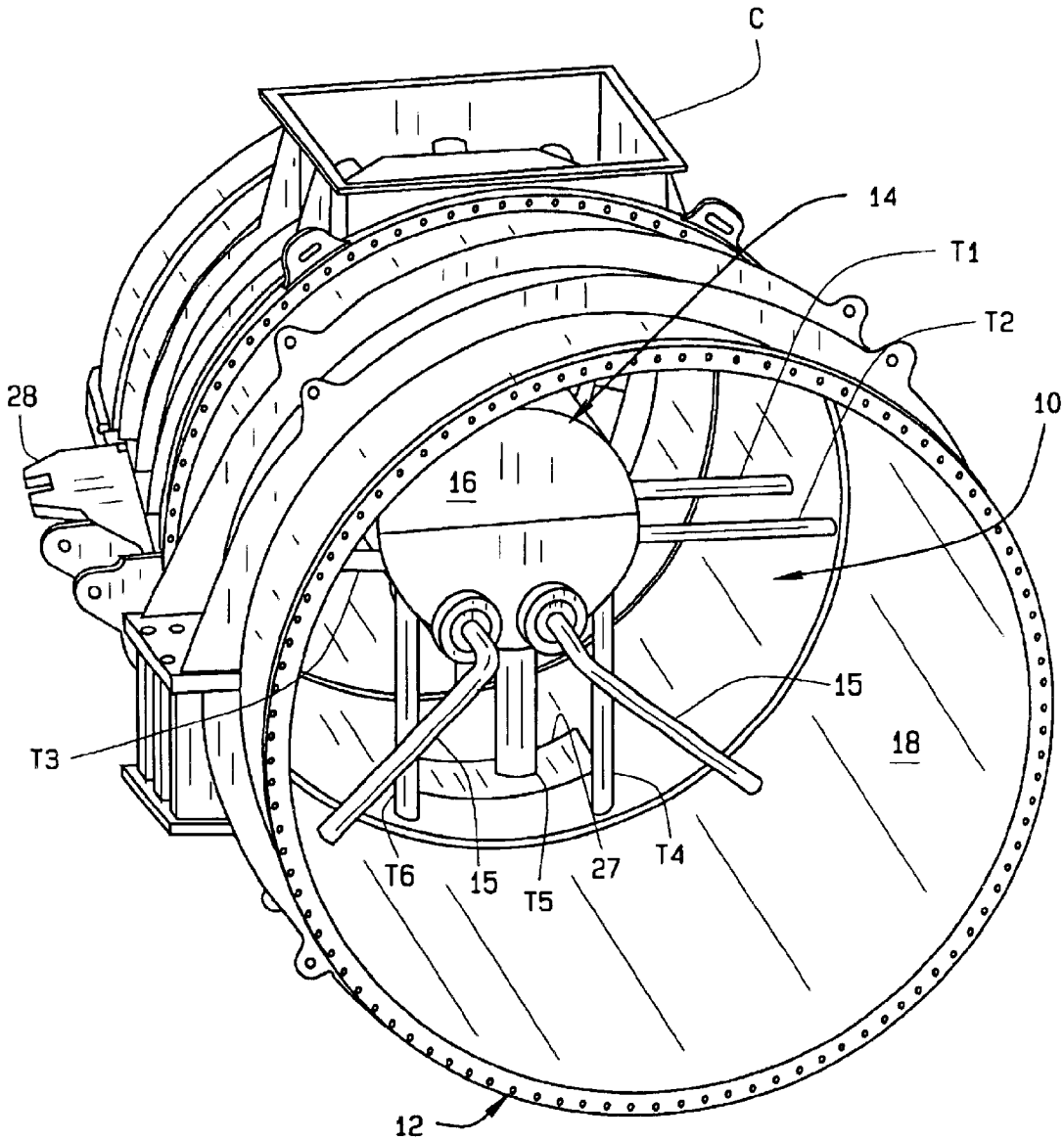
FIG. 2 is a perspective view of another interior of an LP section with a bearing support structure of the present invention; and, FIG. 3 is a perspective view of the exterior of the LP section of FIG. 2 illustrating other structure support features of the invention.

Referring to FIG. 2, a casing for an LP section of a steam turbine includes an LP bearing support structure of the present invention as indicated generally 10. The support structure is installed in a metal shell or casing 12 forming a portion of the low pressure section of the turbine. The shell comprises a hollow cone in which is mounted a bearing housing 14 for a bearing (not shown). As shown in FIG. 2, the bearing housing is mounted concentrically within the shell and extends axially of the shell. Housing 14 comprises a closed ended cylinder or housing supported from its periphery by multiple horizontal and vertical strut members T as described hereinafter. Tubes 15 for venting and sealing the end of the rotor are connected to the housing. The other ends of the tubes attach to a sidewall 18 of the shell.

Figure 1:
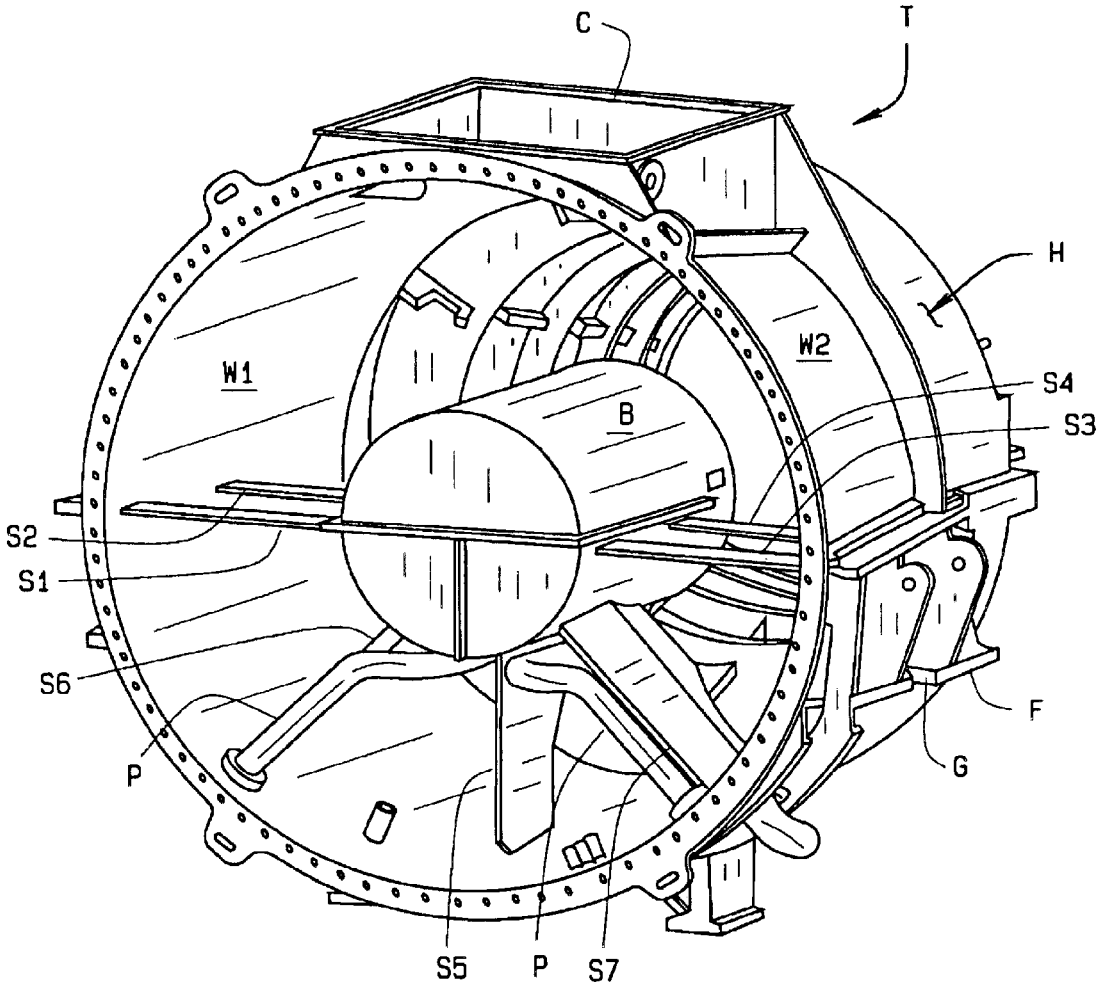
FIG. 1 PRIOR ART
FIG. 1 is a perspective view of the interior of an LP section of a steam turbine with a prior art bearing support structure.
Figure 3:
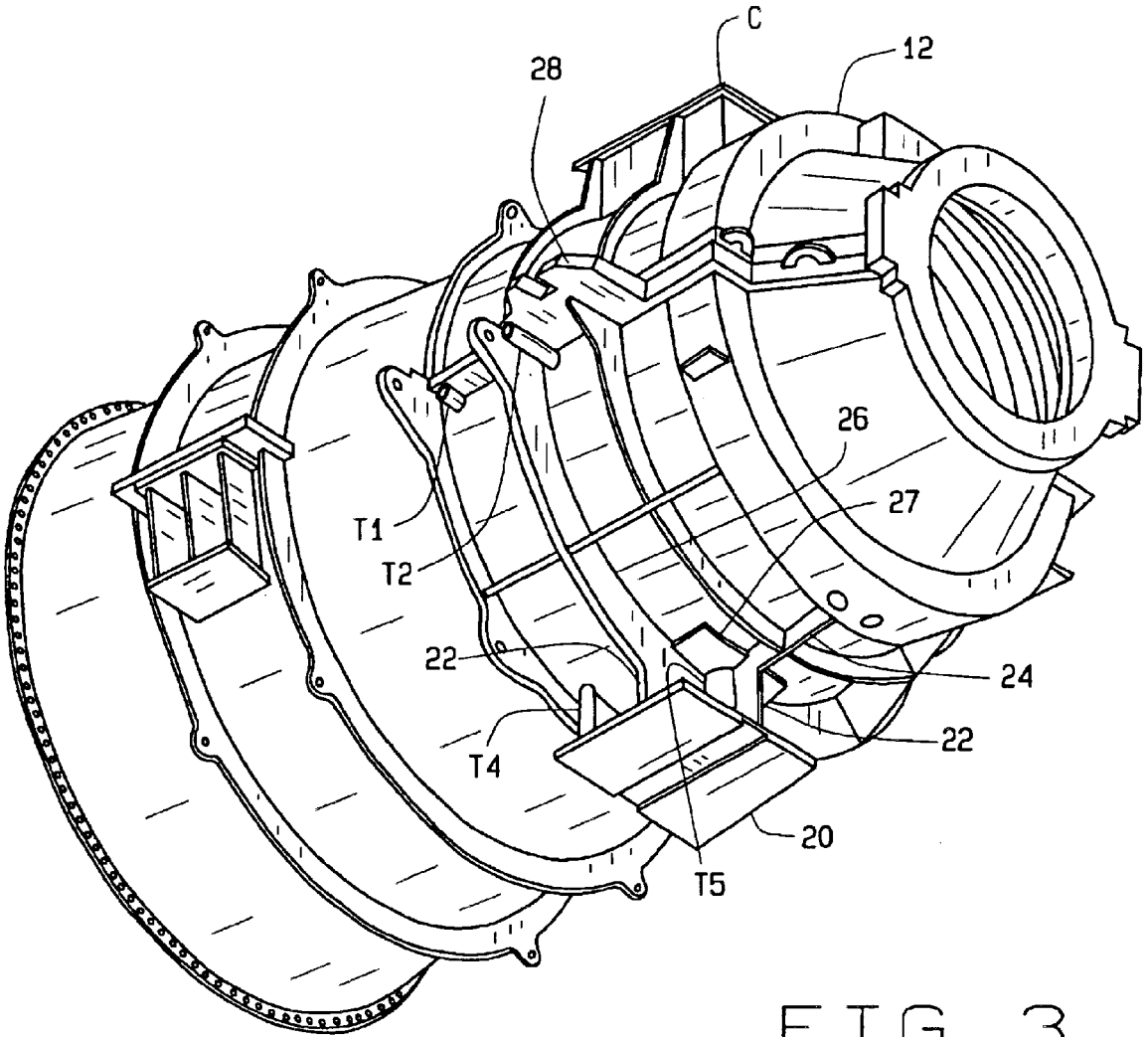

The struts T are first comprised of four horizontal support members of which only three struts T1–T3 are shown in FIG. 2. Two of the struts T1, T2 extend inwardly from sidewall 18 of the shell from one side of the shell, and the other two struts, T3 and the fourth strut (not shown), extend inwardly from wall 18 on the opposite side of the shell. All four of these horizontally extending struts may be identical in size and shape and are co-planar with each other. Whereas the struts S1–S4 used in the conventional bearing housing support structure are comprised of flat plates, as shown in FIG. 1, the horizontally extending struts T of the present invention comprise hollow, generally cylindrical tubes. The inner ends of the tubes are in fluid communication with interior of the bearing housing, and the outer end of the tubes are open to the atmosphere, as shown in FIG. 3. Having the struts comprised of tubes rather than plates has two advantages. First, the tubes provide greater structural integrity than plates. Second, the tubes facilitate venting the interior of housing 14 to the atmosphere. Those skilled in the art will understand that the struts may vary in size and/or shape depending upon the turbine in which they are used.

Bearing support structure 10 next includes three vertically extending struts T4–T6. Unlike the bearing support structure shown in FIG. 1 in which only one of struts S5 is a vertically extending strut, with the other two struts S6 and S7 extending at an angle from the bearing support to the sidewall of the shell; here, all three support struts T4–T6 are vertical struts. The two outer struts T4, T6 are installed adjacent closed end 16 of housing 14, while center strut T5 is installed inwardly from this end of the housing. That is, these struts are not co-planar as are the struts S5–S7 of the conventional arrangement shown in FIG. 1. Strut T5 is located beneath the longitudinal centerline of bearing housing 14, with struts T4 and T6 being spaced equidistantly from the centerline and on opposite sides of it. Because all three struts T4–T6 are vertical struts, they direct any forces imparted to them directly downwardly into foundation plate 20 rather than at an angle as in the support structure of FIG. 1. Further, because the three vertical struts are not in plane with each other, structural stiffness is increased.

As with the struts T1–T3, struts T4–T6 differ in construction from the struts S5–S7 shown in FIG. 1. Now, the struts T4 and T6 comprise tubes, while center strut T5 is shaped like an airfoil. The airfoil shape of strut S5 improves fluid flow through the housing defined by shell 12.

The advantage of bearing support structure 10 over that shown in FIG. 1 is improved structural integrity, better venting of the bearing assembly, and improved support for the bearing in the event of an imbalance of the rotor. Those skilled in the art will further understand that the size, shape, and axial and transverse positions of the seven struts (struts T1–T6 and the fourth horizontal strut not shown) may be varied as required to minimize net hood loss in the LP section and maximize performance of the turbine.

Referring to FIG. 3, a foundation plate is attached to the underside of shell 12 beneath that portion of the shell where the struts T1–T6 are installed. This allows the vertical and horizontal loads to which the LP bearing is subjected to be carried by the plate. Foundation plate 20 is preferably located directly under the bearing on the vertical centerline of the turbine section. The foundation plate is a horizontal plate and is attached to the underside of shell 12 by vertically extending plates 22 which are either separate plates, or form extensions of longitudinally or circumferentially extending ribs 24, 26 respectively. Forces directed downwardly through strut T5 are passed to foundation plate 20 by vertical support plates 22 and 24. Additionally, forces directed through struts T4 and T6 are transmitted directly to foundation plate 20.

In addition to the relocation of the foundation plate from the side of the shell to directly underneath the casing, axial gibs 28, have been relocated so as to now extend along the longitudinal centerline of shell 12. Locating the gibs at the centerline of the casing strengthens the casing and tilting no longer occurs when a vacuum is present within the LP turbine section.

All of the struts, the foundation plate, the gibs, and their constituent elements are fabricated from steel plates or pipes; although, other materials can be used if they are capable of withstanding the environmental constraints and mechanical forces acting on a turbine. As noted, the size and shape of the components forming support structure 10 may vary from one steam turbine construction to another to provide the appropriate bearing support, venting, and flow capabilities within the low pressure section. Installation of the parts is accomplished in any convenient manner; for example, by welding.

A finite element analysis, with respect to the bearing support structure 10 shown in FIGS. 2 and 3, has confirmed an increase in LP bearing support stiffness in both the vertical and horizontal planes. For example, bearing support structure 10 results in an increase in support stiffness of over 350 percent in the vertical direction.

Finally, those skilled in the art will appreciate that bearing support structure 10 of the present invention may be used with any steam turbine where bearing vibration is expected to be an issue, primarily because of low support stiffness. In particular, the bearing support structure of the invention is useful with turbine designs including single flow axial exhaust units, single flow down exhaust units, double flow down exhaust units and double flow side exhaust units.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. In a steam turbine section including a casing (12) in which is installed a housing (14) for a bearing supporting a rotor for buckets, a support structure (10) for the housing comprising a plurality of horizontally extending struts (T1–T3) extending from a sidewall (18) of the casing to the housing, each strut being in fluid communication with the interior of the housing and with the atmosphere for the struts to both support the housing within the casing and to vent the interior of the housing to the atmosphere; and, a plurality of vertically extending struts (T4–T6) extending between the casing and the housing to further support the housing within the casing, two of the vertically extending struts (T4, T6) installed coplanar with each other with a third vertically extending strut (T5) installed therebetween but not in the same plane therewith.

2. The support structure of claim 1 in which one portion of the struts (T1, T2) extends from one side of the casing to the housing and another portion of the struts (T3) extends from the opposite side of the casing to the housing.

3. The support structure of claim 2 in which two struts extend horizontally from the one side of the casing to the housing and two struts extend horizontally from the opposite side of the casing to the housing.

4. The support structure of claim 2 in which each of the struts comprises a tube.

5. The support structure of claim 1 further including a foundation plate (20) installed beneath the casing and connected thereto.

6. The support structure of claim 5 further including at least one gibs (28) mounted to the casing to axially constrain the casing.

7. The support structure of claim 6 further including a pair of gibs (28) which are installed on opposite sides of the casing along the longitudinal centerline of the casing to strengthen the casing and prevent tilting of components within the casing when a vacuum within the casing is applied.

8. The support structure of claim 1 in which the third vertically extending strut is shaped like an airfoil.

9. In a steam turbine section including a casing (12) in which is installed a housing (14) for a bearing supporting a rotor for buckets, a support structure (10) for the housing comprising:

a pair of gibs (28) installed on opposite sides of the casing along the longitudinal centerline thereof to strengthen the casing and prevent tilting of components within the casing when a vacuum within the casing is present;

a plurality of horizontally extending struts (T1–T3) extending from a side (18) of the casing to the housing, each strut being in fluid communication with the interior of the housing and with the atmosphere for the struts to both support the housing within the casing and to vent the interior of the housing to the atmosphere; and, a plurality of vertically extending struts (T4–T6) extending between the casing and the housing to further support the housing within the casing, two of the vertically extending struts (T4, T6) installed coplanar with each other with a third vertically extending strut (T5) installed therebetween but not coplanar therewith.

10. The support structure of claim 9 further including a foundation plate (20) installed beneath the casing and connected thereto.

11. The support structure of claim 9 in which the third vertically extending strut is shaped like an airfoil.

12. The support structure of claim 9 in which two struts extend horizontally from the one side of the casing to the housing and two struts extend horizontally from the opposite side of the casing to the housing.

13. The support structure of claim 9 in which the horizontally extending struts in fluid communication with the interior of the housing and the atmosphere are comprised of tubes.

14. In a steam turbine section including a casing (12) in which is installed a housing (14) for a bearing supporting a rotor for buckets, a support structure (10) for the housing comprising:

a pair of horizontally extending struts (T1–T2) extending from a side (18) of the casing to the housing and a second pair of struts (T3, not shown) extending from the opposite side of the casing to the housing, each strut being in fluid communication with the interior of the housing and with the atmosphere for the struts to both support the housing within the casing and to vent the interior of the housing to the atmosphere;

a plurality of vertically extending struts (T4–T6) extending between the casing and the housing to further support the housing within the casing, two of said vertically extending struts (T4, T6) installed coplanar with each other with a third vertically extending strut (T5) installed therebetween but not coplanar therewith; and, a foundation plate (20) installed beneath the casing and connected thereto; and, a pair of gibs (28) which are installed on opposite sides of the casing along the longitudinal centerline of the casing to strengthen the casing and prevent tilting of components within the casing when a vacuum within the casing is present.

15. The support structure of claim 14 in which the horizontally extending struts in fluid communication with the interior of the housing and the atmosphere are comprised of tubes.

16. The support structure of claim 14 in which the third vertically extending strut is shaped like an airfoil.

* * * * *

UNITED STATES PATENT AND TRADEMARK OFFICE

CERTIFICATE OF CORRECTION

PATENT NO. : 6,821,083 B2
DATED : November 23, 2004
INVENTOR(S) : Lathrop et al.

It is certified that error appears in the above-identified patent and that said Letters Patent is hereby corrected as shown below:

Title page,
Item [54], Title, replace "STREAM" with -- STEAM --.

Column 5,
Line 17, replace "gibs" with -- gib --.
Line 47, should read -- T5 installed there between but struts not coplanar therewith. --.

Signed and Sealed this

Tenth Day of January, 2006

JON W. DUDAS
*Director of the United States Patent and Trademark Office*